US007891498B2

(12) United States Patent
Ernst

(10) Patent No.: US 7,891,498 B2
(45) Date of Patent: Feb. 22, 2011

(54) HIGH CAPACITY LENGTH GRADING MACHINE

(75) Inventor: Matthew J. Ernst, North Oaks, MN (US)

(73) Assignee: Carter Day International, Inc., Minneapolis, MN (US)

( * ) Notice: Subject to any disclaimer, the term of this patent is extended or adjusted under 35 U.S.C. 154(b) by 574 days.

(21) Appl. No.: 11/860,168

(22) Filed: Sep. 24, 2007

(65) Prior Publication Data

US 2008/0073254 A1 Mar. 27, 2008

Related U.S. Application Data

(60) Provisional application No. 60/826,650, filed on Sep. 22, 2006.

(51) Int. Cl.
*B07C 5/12* (2006.01)

(52) U.S. Cl. ..... 209/687; 209/298; 209/684

(58) Field of Classification Search ..... 209/298, 209/684, 687

See application file for complete search history.

(56) References Cited

U.S. PATENT DOCUMENTS 2,135,343 A * 11/1938 Johnson ..... 209/687
2,861,684 A * 11/1958 MacGillivray ..... 209/687
3,612,273 A * 10/1971 Pritchett ..... 209/687
4,722,445 A * 2/1988 Edholm et al. ..... 209/687

OTHER PUBLICATIONS

Carter Day Assembly, Oct. 18, 1979.
Simon-Carter Receiving Head, Jan. 22, 1963.
Simon-Carter Cylinder Conveyer, Apr. 22, 1959.
Heid Machine, date unknown (4 pages).

* cited by examiner

*Primary Examiner*—Patrick Mackey
*Assistant Examiner*—Terrell H Matthews
(74) *Attorney, Agent, or Firm*—Fredrikson & Byron, P.A.

(57) ABSTRACT

A liftings trough for mounting in an interior space of a rotatable member of a length grading machine is defined by walls that are contoured to provide a maximum clearance between the mounted trough and an inlet opening through which grain flows into the interior space of the rotatable member, while maintaining a maximum capacity of the trough to receive granules in a particular size range, which are lifted by pockets located along an interior surface of the rotatable member, when the grain flows into the interior space of the member and the member rotates about the trough.

21 Claims, 5 Drawing Sheets

201
291
294
293
204
203
29
202
292

299
201
291
211
212
231
298
LS1
290
203
293
232
LS2
29
202

29
201
299
298
293

HIGH CAPACITY LENGTH GRADING MACHINE

RELATED APPLICATION

This application claims priority to U.S. provisional application, Ser. No. 60/826,650, which was filed on Sep. 22, 2006, and which is hereby incorporated by reference, in its entirety.

FIELD OF THE INVENTION

The invention relates to length grading machines and more particularly to lifting troughs as employed by high capacity length grading machines.

BACKGROUND

Length grading machines, or grain separators, are typically used to separate a stream of grain containing various types and sizes of grain into its constituent parts, for example, wheat, durum, oats, barley and rice, and/or to separate such grains from other seed contaminants. These machines employ a rotating member, or cylinder, having lifting pockets located along an interior surface thereof, for example, formed by indentations; the pockets, according to their size, receive and lift particular lengths, or sizes of granules out of a stream of grain having been fed into the cylinder as the cylinder rotates. A trough, called a liftings trough, is mounted within the cylinder, to receive the separated granules, which are lifted by the lifting pockets; the trough may include a conveyor, for example, a screw conveyor, to transport the separated granules out from the machine.

In existing length grading machines, lifting troughs have been made larger to handle an increased amount of lifted granules in order to increase separation process efficiency. However, such an enlarged liftings trough, rather than providing the desired increased efficiency, can, by restricting the flow of granules entering the rotating cylinder, cause inlet leakage and pinching that results in a reduced efficiency.

BRIEF DESCRIPTION OF THE DRAWINGS

The following drawings are illustrative of particular embodiments of the invention and therefore do not limit the scope of the invention. The drawings are not to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the invention.

Figure 1A:
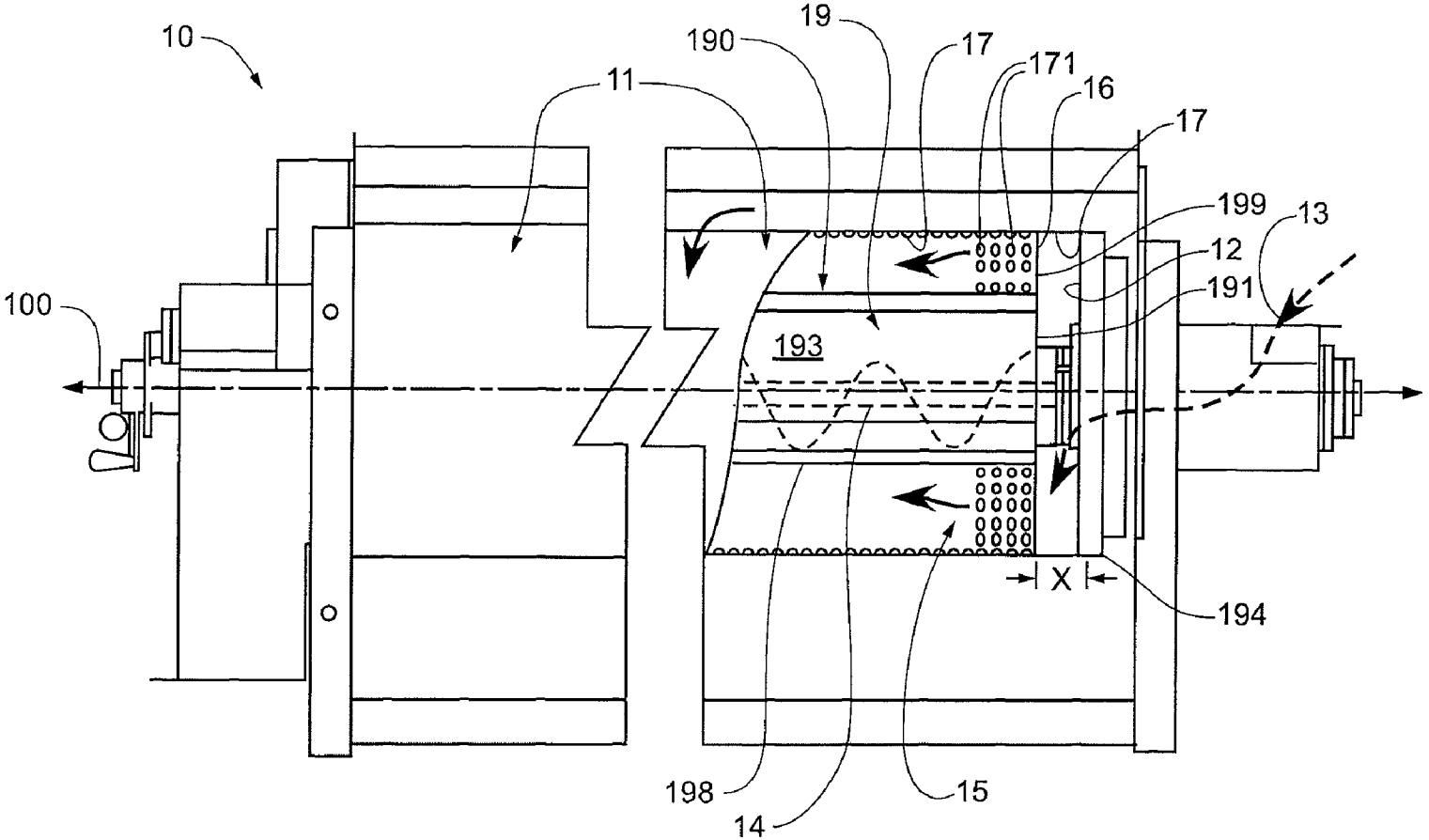
Fig. 1A Prior Art
FIG. 1A is a frontal elevation view of a prior art length grading machine, with a front cover removed to show an interior portion thereof, which includes a cut-away section.
Figure 1B:
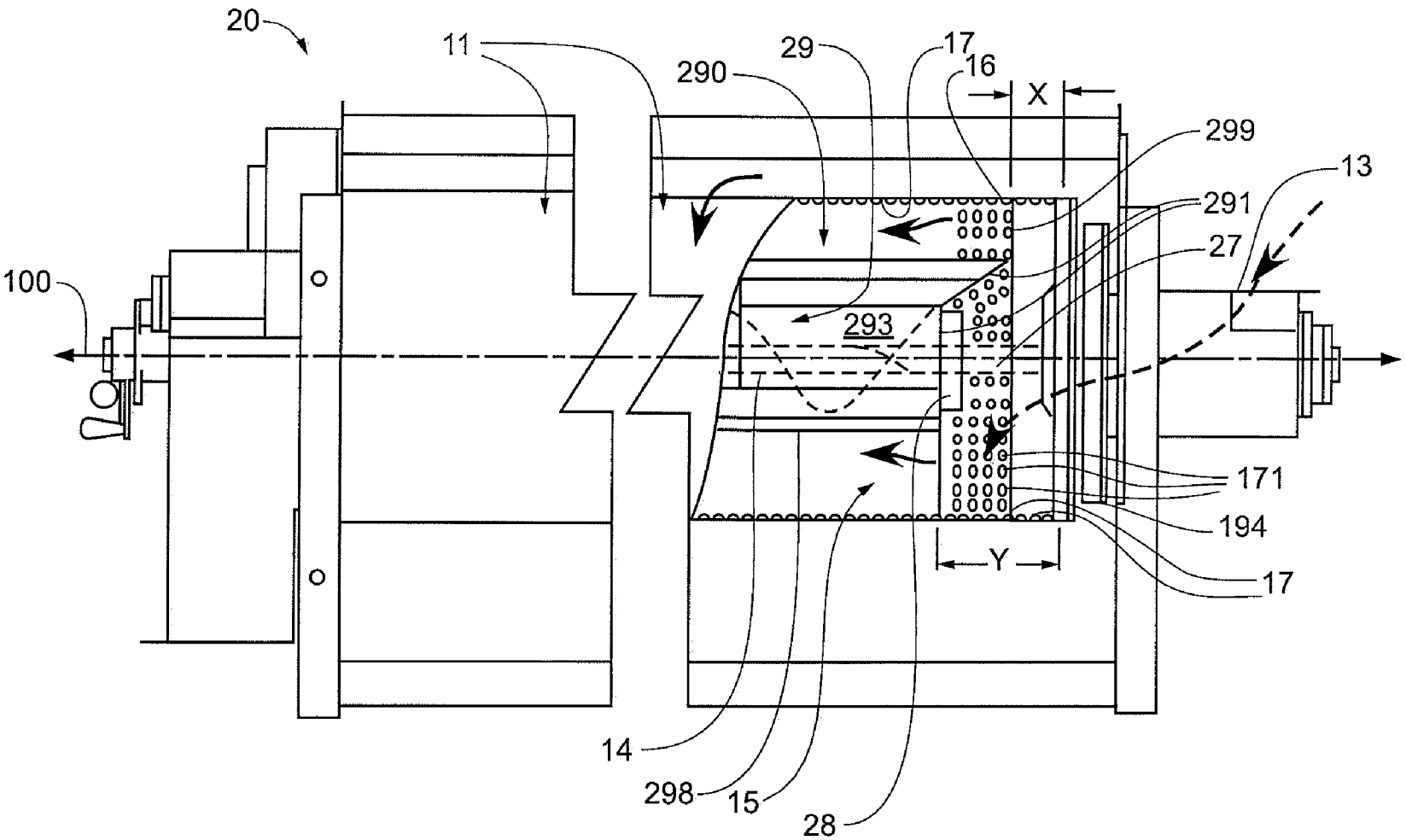
FIG. 1B is a frontal elevation view of a length grading machine, according to exemplary embodiments of the invention, with a front cover removed to show an interior portion thereof, which includes a cut-away section.
Figure 1C:
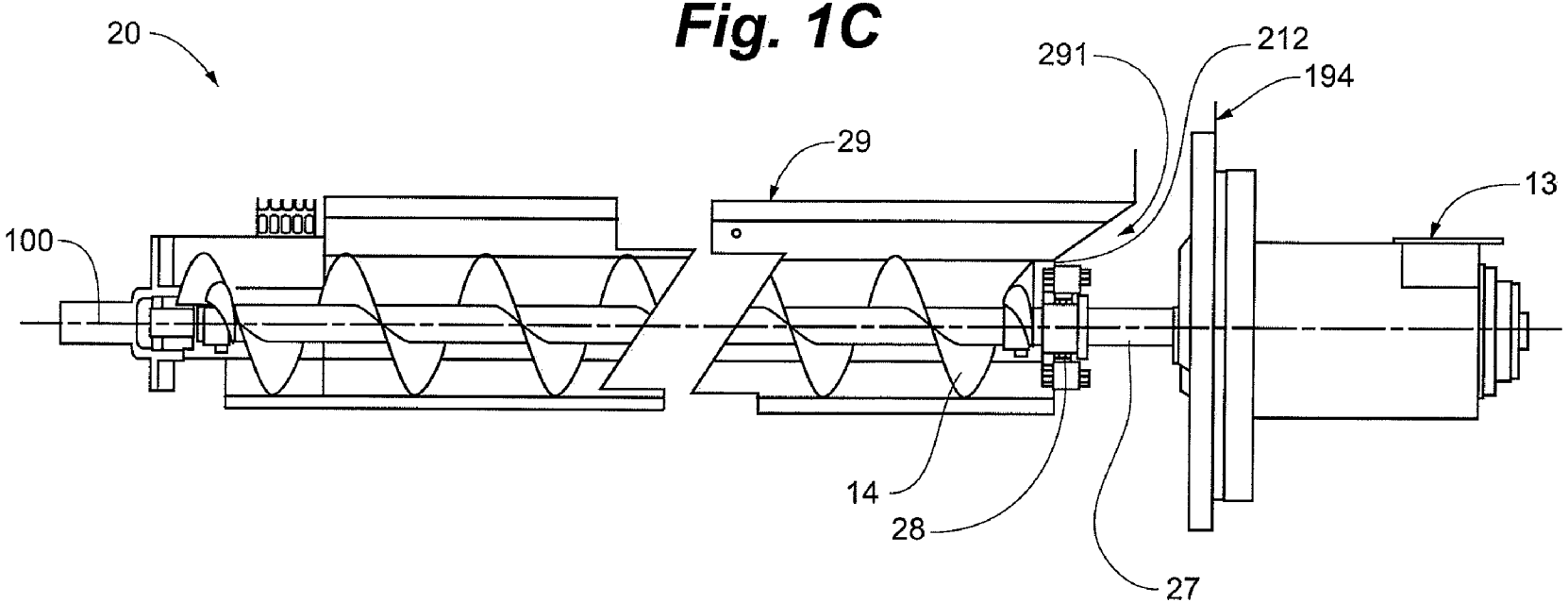
FIG. 1C is a frontal elevation view, including a cut-away section, of a portion of the machine shown in FIG. 1B.

FIG. 1A is a frontal elevation view of a prior art length grading machine 10, and FIG. 1B is a frontal elevation view of a length grading machine 20, according to some embodiments of the invention; each of machines 10, 20 are shown with a front cover removed in order to view an interior portion thereof, which includes a partial cut-away section. FIGS. 1A and B, respectively, show both machines 10, 20 including a rotatable member or cylinder 11 extending about and along a longitudinal axis 100; cylinder 11 includes an interior surface 17, an interior space 15, surrounded by surface 17, and a plurality of lifting pockets 171 located along surface 17, for example, being formed by indentations in surface 17. With reference to FIGS. 1A-B, it should be appreciated that pockets 171 are generally uniformly distributed along interior surface 17, about axis 100 and along axis 100, over an axial length of cylinder 11, generally starting at a point 16. (For simplicity in illustration, only a portion of the plurality of pockets 171 is shown and squiggly arrows indicate the extent thereof over the axial length of cylinder 11.) FIGS. 1A-B further illustrate an inlet passageway 13, the extent of which is schematically illustrated with a bold dashed line; inlet passageway 13 opens into interior space 15 of cylinder 11 in order to deliver a flow of granular material thereto for separation, via rotation of cylinder 11.

Pockets 171 are sized to lift granules, which are in a particular size range, from the delivered stream of granules, as cylinder 11 rotates. FIG. 1A illustrates machine 10 including a liftings trough 19 mounted within cylinder 11 to receive the lifted granules therein, via an upper opening 190 thereof. It should be understood that upper opening 190 is bounded by an upper edge of two opposing end walls of trough 19, one of which is shown as an end wall 191, and by two opposing longitudinal walls of trough 19, one of which is shown as a longitudinal wall 193. Trough 19 is configured and located within cylinder 11, at a distance X from an opening through a receiving head 194 for inlet passageway 13, in order to receive a quantity of lifted granules and to accommodate a screw conveyor 14 extending therein (shown with dashed lines in FIG. 1A), which conveyor transports the lifted granules axially along trough 19 and out from machine 10. However, the illustrated location of end wall 191 of trough 19, and an intersection thereof with longitudinal wall 193 and a bottom wall 198 of trough 19, in relatively close proximity to the opening of inlet passageway 13 into interior space 15 of cylinder 11, can cause a bulk of granules flowing into cylinder 11 to become pinched between trough 19 and an inner end wall 12 of cylinder 11. This pinching can cause granules that would not otherwise be lifted by pockets 171 to be lifted, and/or cause a portion of granules to leak out from cylinder 11, at a sealed interface thereof in proximity to end wall 12, thereby significantly reducing the quantity of granules making contact with interior surface 17 of cylinder 11, and, thus, reducing an overall separation process efficiency of machine 10. FIG. 1B illustrates machine 20 including a liftings trough 29 mounted within cylinder 11, which trough 29 has an upper opening 290 that is similar in receiving capacity to opening 190 of trough 19. Yet, trough 29 has an improved configuration in order to avoid the type of pinching and leakage that is caused by the configuration of trough 19 in machine 10.

Figures 2A, 2B, 2C:
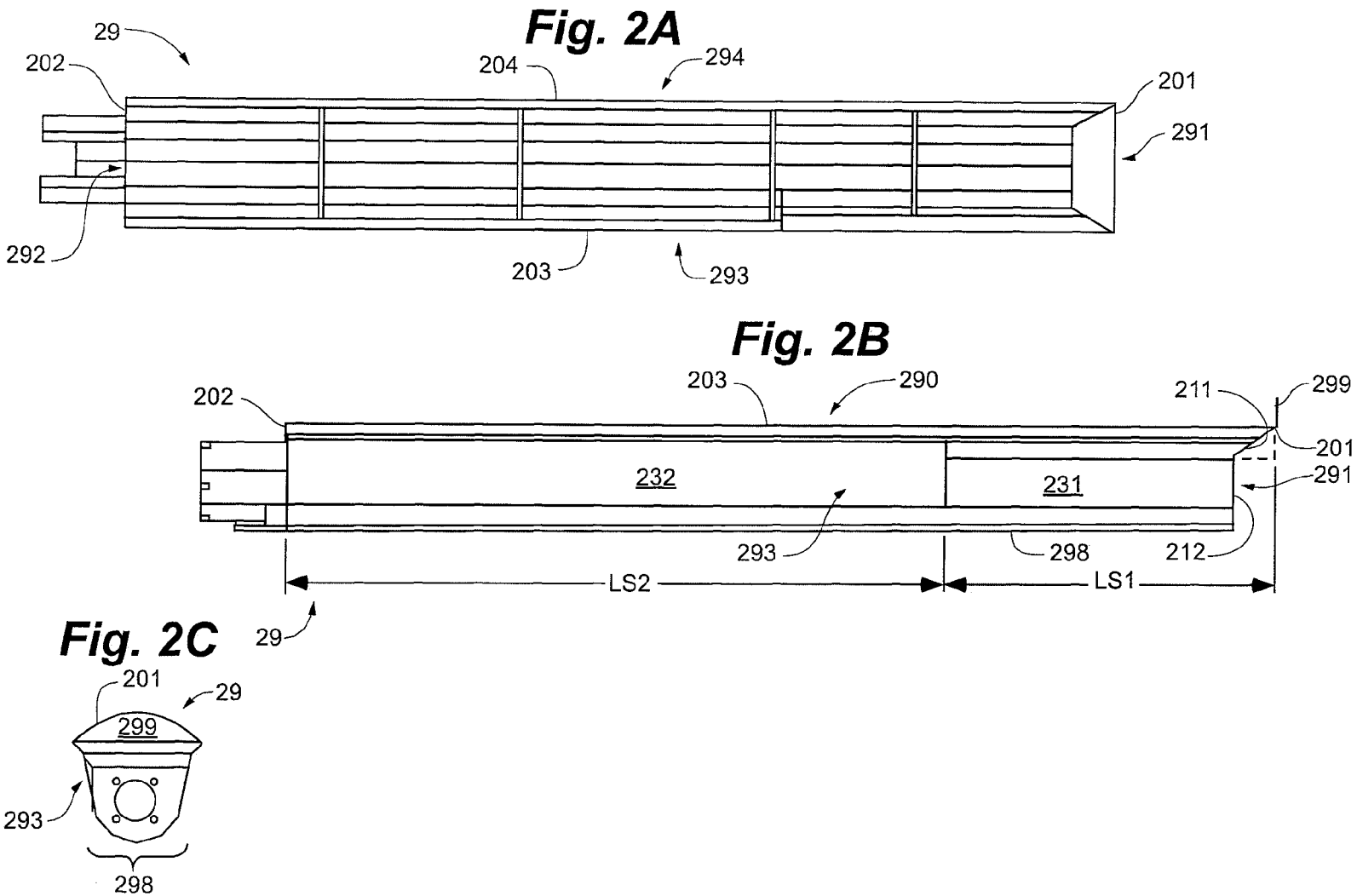
FIG. 2A is a top plan view of a liftings trough, according to some embodiments of the invention.
FIG. 2B is a frontal elevation view of the liftings trough of FIG. 2A.
FIG. 2C is an end view of the liftings trough of FIG. 2A.

Turning now to FIGS. 2A-C, the configuration of trough 29, according to some embodiments of the invention, will be defined. FIG. 2A is a top plan view of trough 29; FIG. 2B is a frontal elevation view of trough 29; and FIG. 2C is an end view of trough 29. FIGS. 2A-C illustrate trough 29 including a first end wall 291, a second end wall 292 opposing first end wall 291, a first longitudinal wall 293 extending between first and second end walls 291, 292, a second longitudinal wall 294 opposing first longitudinal wall 293 and extending between first and second end walls 291, 292, and a bottom wall 298 extending from first end wall 291 to second end wall 292 and from first longitudinal wall 293 to second longitudinal wall 294. Each of walls 291, 292, 293 and 294 is shown including an upper edge 201, 202, 203, and 204, respectively, each of which bound upper opening 290 of trough 29.

According to the illustrated embodiment, a maximum length from upper edge 201 of first end wall 291 to upper edge 202 of second end wall 292 is greater than a maximum length of bottom wall 298 extending from first end wall 291 to second end wall 292. With reference back to FIGS. 1A-B, it may be appreciated that trough 29 is mounted within cylinder 11 such that opening 290 is located the same distance X from the opening for inlet passageway 13 as opening 190 of trough 19, yet trough 29, due to the above-described configuration, provides greater clearance for the flow of granules into cylinder via inlet passageway 13, since an intersection of bottom wall 298 with first end wall 291 is offset from the opening through the receiving head 194 at a greater distance Y. According to an exemplary embodiment of the invention, distance Y is greater than distance X by more than about 3 inches (e.g., about 3.5 inches or more). With further reference to FIG. 1B, according to certain embodiments, an axial length of upper opening 290 of the trough within cylinder 11 is at least as long as the axial length of cylinder 11 over which the plurality of lifting pockets 171 extend, while bottom wall 298 has a length that is less than the axial length of cylinder 11 over which the plurality of lifting pockets 171 extend. FIGS. 1B and 2B-C further illustrate trough 29 including a first end wall extension 299, similar to a wall extension 199 of trough 19, shown in FIG. 1A; each of troughs 19, 29 is shown mounted within interior space 15 of cylinder 11 such that the corresponding extension 199, 299 coincides with point 16 that marks an edge of the plurality of lifting pockets 171.

FIG. 2B further illustrates first end wall 291 including a slanted portion 211 extending downward and inward, toward second end wall 292, from upper edge 201, to provide the additional clearance, shown in FIG. 1B, in proximity to the opening of inlet passageway 13; another portion 212 of first end wall 291 is shown extending between slanted portion 211 and bottom wall 298 and being approximately orthogonal to a plane defined by upper opening 290. Although slanted portion 211 of wall 291 is shown, the invention is not so limited, and, for example, according to some alternate embodiments, end wall 291 includes a pair of orthogonally disposed portions, for example as illustrated by dashed lines in FIG. 2B. With reference to FIGS. 1B and C, it may be appreciated trough 29 also accommodates the screw conveyor 14, which conveyor is mounted on a shaft 27 that extends through portion 212 of first end wall 291 and is supported by a bearing assembly 28 mounted to first end wall 291.

With further reference to FIG. 2B, first longitudinal wall 293 of trough 29 includes a first longitudinal section 231 and a second longitudinal section 232. First longitudinal section 231 is shown extending from an intersection with first end wall 291 toward second longitudinal section 232, over an axial length LS1; and second longitudinal section 232 is shown extending from first longitudinal section 231 toward second end wall 292, over an axial length LS2. According to some embodiments of the invention, axial length LS1 is less than an axial length LS2, for example, LS1 may be approximately one third of an overall axial length of trough 29, while length LS2 is approximately two thirds of the overall length. In some embodiments, LS1 is less than approximately one third of an overall axial length of trough 29, while length LS2 is greater than approximately two thirds of the overall length. According to alternate embodiments, first longitudinal wall 293 may include additional longitudinal sections extending between first and second end walls 291, 292.

Figure 2D:
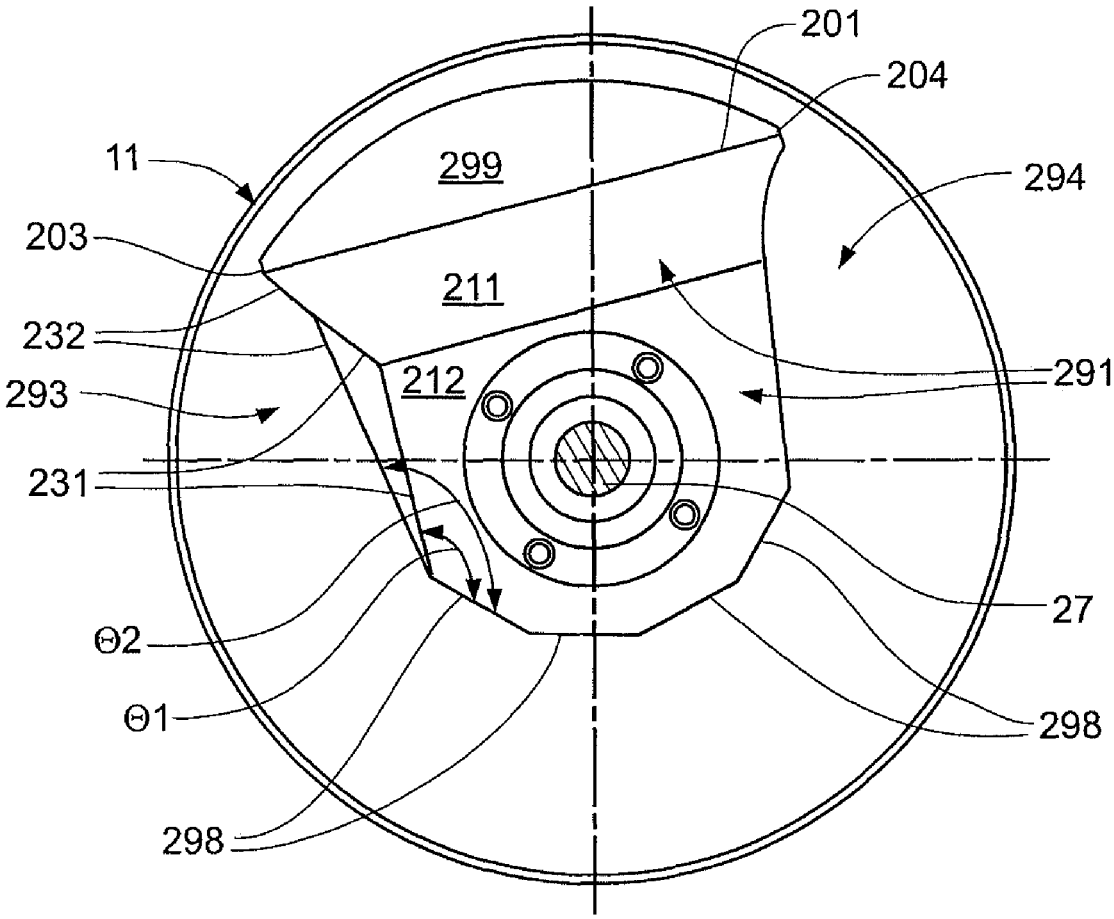
FIG. 2D is an enlarged end view of the liftings trough mounted within a rotatable member of a length grading machine, for example as shown in FIG. 1B.

Turning now to FIG. 2D, which is an enlarged end view of trough 29 mounted within rotatable member 11, a contour of first longitudinal section 231 may be compared to that of second longitudinal section 232. FIG. 2D illustrates first longitudinal section 231 of first longitudinal wall 293 extending upward from bottom wall 298 at an angle θ1 which is less than an angle θ2 at which second longitudinal section 232 extends with respect to bottom wall 298. Although FIGS. 2C-D illustrate bottom wall 298 of trough 29 being multi-faceted, the invention is not so limited, and bottom wall 298 may have any suitable contour. According to the illustrated embodiment, the contour of first longitudinal section 231 provides additional clearance, in proximity to the opening of inlet passageway 13 into cylinder 11, for the flow of granular material. With further reference to FIGS. 2A-D, it should be appreciated that longitudinal sections 231, 232 are coterminous at upper edge 203 of first longitudinal wall 293, and that a contour of second longitudinal section 232 may be representative of that of an entire length of longitudinal wall 193 of trough 19 (FIG. 1B). Thus, it may be appreciated that a capacity of upper opening 290 of trough 29 to receive lifted granules may match that of upper opening 190 of trough 19, yet, the configuration of trough 29 provides for an increased clearance at the opening of inlet passageway 13 into cylinder 11. The increased clearance provided by the illustrated embodiment of trough 29, when substituted for trough 19, may increase thru put of a lifting machine by up to about 20%.

In the foregoing detailed description, the invention has been described with reference to specific embodiments. However, it may be appreciated that various modifications and changes can be made without departing from the scope of the invention as set forth in the appended claims.

The invention claimed is:

1. A length grading machine comprising:

a rotatable member extending about and along a longitudinal axis, the rotatable member including an interior surface, an interior space surrounded by the interior surface, and a plurality of lifting pockets located along the interior surface and extending over an axial length of the rotatable member, the lifting pockets for lifting granules in a particular size range from a lower position to a higher position within the interior space of the rotatable member, when the rotatable member rotates; an inlet passageway opening into the interior space of the rotatable member, the inlet passageway for delivering a stream of granules into the interior space; and a trough mounted within the interior space of the rotatable member, the trough comprising: a first end wall located in proximity to the inlet passageway, a second end wall opposing the first end wall, a first longitudinal wall extending between the first and second end walls, a second longitudinal wall opposing the first longitudinal wall and extending between the first and second end walls, and a bottom wall extending from the first end wall to the second end wall and from the first longitudinal wall to the second longitudinal wall; and an upper opening to receive the lifted granules in the particular size range, the upper opening bounded by an upper edge of each of the first and second end walls, and by an upper edge of each of the first and second longitudinal walls; wherein the upper edge of the first end wall of the trough is located at a first distance, along the longitudinal axis, from the inlet opening; and an intersection of the bottom wall with the first end wall of the trough is located a second distance, along the longitudinal axis, from the inlet opening; and the second distance is greater than the first distance; wherein the first longitudinal wall of the trough includes a first longitudinal section and a second longitudinal section; the first longitudinal section extends from an intersection with the first end wall toward the second longitudinal section, and upward from the bottom wall toward the upper edge of the first longitudinal wall of the trough at a first angle with respect to the bottom wall; the second longitudinal section extends from the first longitudinal section toward the second end wall of the trough, and upward from the bottom wall toward the upper edge of the first longitudinal wall of the trough at a second angle with respect to the bottom wall; and the first angle being less than the second angle, and the first and second longitudinal sections being conterminous at the upper edge of the first longitudinal wall.

2. The length grading machine of claim 1, wherein the first end wall of the trough includes a slanted portion extending downward and inward from the upper edge thereof, toward the second end wall and away from the inlet passageway.

3. The length grading machine of claim 2, wherein the first end wall of the trough further includes another portion extending between the slanted portion and the bottom wall of the trough and being approximately orthogonal to a plane defined by the upper opening of the trough.

4. The length grading machine of claim 3, further comprising a screw conveyor extending within the interior of the trough; and wherein the other portion of the first end wall of the trough is adapted to accommodate a shaft of the screw conveyor extending therethrough.

5. The length grading machine of claim 1, wherein a maximum length from the upper edge of the first end wall of the trough to the upper edge of the second end wall of the trough is greater than a maximum length of the bottom wall of the trough, from the first end wall to the second end wall.

6. The length grading machine of claim 1, wherein the second distance is greater than the first distance by more than about 3 inches.

7. The length grading machine of claim 1, wherein the upper opening has an axial length, which is at least as long as the axial length of the rotatable member over which the plurality of lifting pockets extends.

8. The length grading machine of claim 1, wherein the first longitudinal section of the first longitudinal wall of the trough has an axial length that is less than an axial length of the second longitudinal section of the second longitudinal wall of the trough.

9. The length grading machine of claim 1, wherein the second longitudinal section of the first longitudinal wall of the trough is at least about two thirds of an overall axial length of the trough.

10. The length grading machine of claim 1, further comprising a screw conveyor extending within the interior of the trough; and wherein the first end wall of the trough is adapted to accommodate a shaft of the screw conveyor extending therethrough.

11. A liftings trough for mounting in an interior space of a rotatable member of a length grading machine, the rotatable member including an interior surface, surrounding the interior space, and a plurality of lifting pockets located along the interior surface and extending over an axial length of the rotatable member, the lifting pockets for lifting granules in a particular size range from a lower position to a higher position within the interior space of the rotatable member, when the rotatable member rotates; the liftings trough comprising: a first end wall, a second end wall opposing the first end wall, a first longitudinal wall extending between the first and second end walls, a second longitudinal wall opposing the first longitudinal wall and extending between the first and second end walls, and a bottom wall extending from the first end wall to the second end wall and from the first longitudinal wall to the second longitudinal wall; and an upper opening to receive the lifted granules in the particular size range, when the trough is mounted within the rotatable member of the length grading machine, the opening bounded by an upper edge of the each of the first and second end walls, and by an upper edge of each of the first and second longitudinal walls; wherein a maximum length from the upper edge of the first end wall to the upper edge of the second end wall is greater than a maximum length of the bottom wall extending from the first end wall to the second end wall, and wherein the first longitudinal wall of the trough includes a first longitudinal section and a second longitudinal section; the first longitudinal section extends from an intersection with the first end wall toward the second longitudinal section, and upward from the bottom wall toward the upper edge of the first longitudinal wall of the trough at a first angle with respect to the bottom wall; the second longitudinal section extends from the first longitudinal section toward the second end wall of the trough, and upward from the bottom wall toward the upper edge of the first longitudinal wall of the trough at a second angle with respect to the bottom wall; and the first angle being less than the second angle, and the first and second longitudinal sections being conterminous at the upper edge of the first longitudinal wall.

12. The liftings trough of claim 11, wherein the first end wall includes a slanted portion extending downward and inward from the upper edge thereof, toward the second end wall.

13. The liftings trough of claim 12, wherein the first end wall further includes another portion extending between the slanted portion and the bottom wall, and being approximately orthogonal to a plane defined by the upper opening.

14. The liftings trough of claim 13, wherein the other portion of the first end wall is adapted to accommodate a shaft of a screw conveyor extending therethrough.

15. The liftings trough of claim 11, wherein the upper opening has an axial length, which is at least as long as the axial length of the rotatable member, of the length grading machine, over which the plurality of lifting pockets extends.

16. The liftings trough of claim 11, wherein the first longitudinal section of the first longitudinal wall has an axial length that is less than an axial length of the second longitudinal section of the second longitudinal wall.

17. The liftings trough of claim 11, wherein the second longitudinal section of the first longitudinal wall is approximately two thirds of an overall axial length of the trough.

18. The liftings trough of claim 11, wherein the first end wall is adapted to accommodate a shaft of a screw conveyor extending therethrough.

19. A length grading machine comprising:

a rotatable member extending about and along a longitudinal axis, the rotatable member including an interior surface, an interior space surrounded by the interior surface, and a plurality of lifting pockets located along the interior surface and extending over an axial length of the rotatable member, the lifting pockets for lifting granules in a particular size range from a lower position to a higher position within the interior space of the rotatable member, when the rotatable member rotates; an inlet passageway opening into the interior space of the rotatable member, the inlet passageway for delivering a stream of granules into the interior space; and a trough mounted within the interior space of the rotatable member, the trough comprising: a first end wall located in proximity to the inlet passageway, a second end wall opposing the first end wall, a first longitudinal wall extending between the first and second end walls, a second longitudinal wall opposing the first longitudinal wall and extending between the first and second end walls, and a bottom wall extending from the first end wall to the second end wall and from the first longitudinal wall to the second longitudinal wall; and an upper opening to receive the lifted granules in the particular size range, the upper opening bounded by an upper edge of each of the first and second end walls, and by an upper edge of each of the first and second longitudinal walls; wherein the first longitudinal wall of the trough includes a first longitudinal section and a second longitudinal section; the first longitudinal section extends from an intersection with the first end wall toward the second longitudinal section, and upward from the bottom wall toward the upper edge of the first longitudinal wall of the trough at a first angle with respect to the bottom wall; the second longitudinal section extends from the first longitudinal section toward the second end wall of the trough, and upward from the bottom wall toward the upper edge of the first longitudinal wall of the trough at a second angle with respect to the bottom wall; and the first angle being less than the second angle, and the first and second longitudinal sections being conterminous at the upper edge of the first longitudinal wall.

20. The length grading machine of claim 19, wherein the first longitudinal section of the first longitudinal wall of the trough has an axial length that is less than an axial length of the second longitudinal section of the second longitudinal wall of the trough.

21. The length grading machine of claim 19, wherein the second longitudinal section of the first longitudinal wall of the trough is at least about two thirds of an overall axial length of the trough.

* * * * *